United States Patent [19]

Garner et al.

[11] 4,246,051

[45] Jan. 20, 1981

[54] PYROTECHNIC COATING COMPOSITION

[75] Inventors: Eugene F. Garner, Canyon Country; Alvin A. Seldner, Saugus, both of Calif.

[73] Assignee: Allied Chemical Corporation, Morris Township, Morris County, N.J.

[21] Appl. No.: 942,587

[22] Filed: Sep. 15, 1978

[51] Int. Cl.[3] ..... C06B 45/34; C06B 45/10

[52] U.S. Cl. ..... 149/7; 149/19.6; 149/19.91; 149/82; 149/83; 149/85; 149/86

[58] Field of Search ..... 149/19.6, 19.91, 82, 149/83, 85, 86, 7

[56] References Cited

U.S. PATENT DOCUMENTS 3,986,908 10/1976 Grébert et al. ..... 149/83

4,128,996 12/1978 Garner et al. ..... 149/83

FOREIGN PATENT DOCUMENTS 2063586 7/1971 Fed. Rep. of Germany ..... 149/44

*Primary Examiner*—Edward A. Miller

*Attorney, Agent, or Firm*—Roger H. Criss

[57] ABSTRACT

An ignition enhancer coating composition for pyrotechnic propellants comprised of about 60 to 95 wt. % of an inorganic oxidizer; about 5 to 20 wt. % of an oxygen-containing polymeric compound; about 0 to 10 wt. % polyethylene; about 0 to 10 wt. % of a transition-metal oxide; and about 0 to 5 wt. % carbon black. This invention also relates to a pyrotechnic propellant coated with said ignition enhancer composition.

10 Claims, No Drawings

PYROTECHNIC COATING COMPOSITION

BACKGROUND OF THE INVENTION

1. Field of the Invention

This invention relates to an ignition enhancer coating composition for pyrotechnic propellants, especially those propellants suitable for use in inflating an inflatable device, such as a vehicle safety restraint.

2. Description of the Prior Art

Various pyrotechnic propellants have been prepared for generating a gas upon combustion in order to inflate an air bag or similar safety restraint in a vehicle so as to restrain movement of an occupant in the event of a sudden deceleration of the vehicle, such as caused by a collision. In order to be employed as a pyrotechnic gas generating composition for inflatable occupant restraints, several criteria must be met. The pyrotechnic must be capable of producing non-toxic, non-flammable and essentially smokeless gases over a wide variety of temperatures and other environmental conditions. The gases that are generated must be totally ignited at a sufficiently low temperature so as not to destroy the restraint or injure the occupant. The pyrotechnic must also be safe to handle and must be capable of generating a substantial amount of gas within a very short period of time, e.g., less than about 100 milliseconds.

In order to achieve total ignition and combustion of the pyrotechnic formulation various additional ingredients have been employed. Such ingredients include copper chromite and iron oxide as taught in U.S. Pat. No. 3,933,543, or a mixture of inorganic oxidizer compounds and an oxygen bearing organic fuel as taught in U.S. Pat. No. 3,964,255. These ingredients are conventionally taught as being admixed with the pyrotechnic propellant before the propellant is pressed into pellets. Although such admixtures are effective to a degree, there is still a need for a more effective ignition enhancer as well as a need for a more effective combination of propellant and ignition enhancer.

SUMMARY OF THE INVENTION

In accordance with the invention, there is provided an ignition enhancer composition, preferably applied as a coating on pyrotechnic propellants suitable for use in automobile safety restraint devices, comprised of about 60 to 95 wt. % of an inorganic oxidizer, preferably sodium perchlorate or potassium perchlorate; about 5 to 20 wt. % of an oxygen-containing polymeric compound, preferably a polyvinyl acetate resin; about 0 to 10 wt. % polyethylene having a particle size of equal to or less than about 100 mesh, preferably about 300 mesh; about 0 to 10 wt. % of a transition-metal oxide, preferably iron oxide; and about 0 to 5 wt. % carbon black. The ignition enhancer, especially when used as a coating for pyrotechnic propellants, is superior in enhancing full ignition of the propellant within a very short period of time.

In a preferred embodiment of the present invention a pyrotechnic propellant, in pellet form, is coated with a composition comprised of about 75 to 85 wt % of an inorganic oxidizer, preferably, potassium perchlorate; about 9 to 11 wt. % of an oxygen-containing polymeric compound, preferably, a polyvinyl acetate resin; about 3 to 7 wt. % of a transition-metal oxide, preferably iron oxide; about 1 to 5 wt. % polyethylene; and about 0.5 to 2 wt. % carbon black.

DETAILED DESCRIPTION

Pyrotechnic propellant compositions for which the present ignition enhancers are suitable for use are generally any of those pyrotechnic propellants conventionally known in the art. Such pyrotechnic propellants generate a gas upon combustion and are generally comprised of mixtures of chemical components, such as fuels and oxidizers and optionally binders, and other propellant adjuvants, which may be activated by, for example, an electrically energized squib to generate substantial volumes of gas for inflating such devices as crash bags.

The present leading candidates for commercialization in an all-pyrotechnic inflation system are sodium azide-based compositions, although the present ignition enhancer compositions are equally suitable for use on non-azide pyrotechnic propellants. Such compositions exhibit excellent gas generating properties and produce a gas which consists almost totally of nontoxic nitrogen gas.

Preferably, the pyrotechnic propellant is in the form of grains or pellets which have a geometry which provides a substantially constant surface area exposed to burning during combustion. By use of the present invention rapid onset of gas generation is assured preferably by coating the present ignition enhancer onto the surface of the pyrotechnic propellant.

Oxygen-containing polymeric compounds suitable for use in the present ignition enhancer compositions are those combustible polymeric materials containing a substantial amount of oxygen. Non-limiting examples of such compounds include polyacetal resins including both homopolymers and copolymers, polyvinyl acetate resins, polyesters, polyurethanes, polyester-polyurethane copolymers, polycarbonates and polymers based on cellulose compounds such as cellulose acetate, and the like. Preferred are the polyacetal resins and polyvinyl acetate, more preferred is polyvinyl acetate.

Non-limiting examples of inorganic oxidizers suitable for use in the present invention include the alkali metal oxidizers such as sodium chlorate, potassium chlorate, sodium perchlorate, potassium perchlorate, sodium chlorite, sodium nitrate, sodium nitrate, potassium nitrate, as well as ammonium chlorate, ammonium perchlorate, ammonium nitrate, and the like. Also, bromates or iodates may be employed instead of the corresponding chlorates (or perchlorates). Preferred are the sodium and potassium chlorates and perchlorates, more preferred are sodium and potassium perchlorate, and most preferred is potassium perchlorate.

Non-limiting examples of transition metal oxides suitable for use in the present ignition enhancer compositions are iron oxide, copper oxide, manganese oxide, titanium oxide, and vanadium oxide; preferred are ferric oxide, ferrous oxide and copper oxide, and more preferred is ferric oxide.

The term "polyethylene" as used herein includes homopolymers of ethylene as well as copolymers obtained by reacting ethylene with a small amount of a comonomer. Non-limiting examples of such comonomers include $C_3$ to $C_8$ 1-alkenes such as propylene, butene-1,2-methylpropene-1, 4-methylpentene-1, and pentene-1 and the like, as well as mixtures thereof. Generally the copolymer contains at least 85 weight percent, and preferably not less than 96 weight percent of polymer units derived from ethylene. Such copolymers have essentially the same characteristics as the ethylene homopolymer of the same molecular weight, e.g. the preforming and sintering characteristics are the same.

The polyethylene resin suitable for use as starting material in the present invention may be prepared by any conventional procedure. One such procedure is a low pressure ethylene polymerization process using a chromimum oxide catalyst on a silica or silicaalumina support in paraffinic or cycloparaffinic solvent thereby forming polyethylene in solution or as discrete particles in a hydrocarbon slurry. Another procedure suitable for preparing polyethylene suitable for use herein is the Ziegler process which teaches the use of an active metal alkyl catalyst, or by such other processes as described in U.S. Pat. No. 3,050,514 or especially the process outlined in U.S. Pat. No. 3,051,993. The latter process involves at least intermittently contacting anhydrous oxygen-free ethylene in the gaseous phase with an inorganic, porous, frangible, solid contact catalyst prepared from an inorganic compound of chromium and oxygen and an active metal alkyl.

Generally the polyethylene resins suitable for use as fuel/binders in the present invention have densities from about 0.92 to 0.97 at 23° C., as determined by ASTM Method D792. Their crystalline melting point is in the order of about 275° F.

The polyethylene suitable for use herein is in granular form wherein the granules are of a particle size of less than or equal to about 150 (microns), preferably about 15 to 65, more preferably about 25 to 50.

The ignition enhancer compositions of the present invention are comprised of about 60 to 95 wt. %, preferably about 75 to 85 wt. % inorganic oxidizer; about 5 to 20 wt. %, preferably about 9 to 11 wt. % combustible oxygen-containing polymeric compound; about 0 to 10 wt. %, preferably about 3 to 7 wt. % transition-metal oxide; about 0 to 10 wt. %, preferably about 1 to 5 wt. % polyethylene; and about 0 to 5 wt. %, preferably 0.5 to 2 wt. % carbon black. All weight percents are based on the total weight of the ignition enhancer composition.

It is preferred that the ignition enhancer composition of the present invention be used as a coating for pyrotechnic propellants although it can also be admixed with the propellant in granules form before the propellant is compressed into pellets. When these ignition enhancer compositions are used in coating-form, superior results are obtained over their use as when admixed with the propellants.

The method of applying the ignition enhancer composition to the propellant is not critical. One preferred method of coating the propellant is by first preparing a coating mix. This is accomplished by adding the oxygen-containing polymeric compound and the polyethylene in an appropriate solvent such as methylene chloride in a mixing vessel such as a ball mill jar. The carbon black, inorganic oxidizer and grinding balls are then placed in the jar and placed on a ball mill for a time sufficient to put the solids into suspension—generally up to about 12 hours. The propellant to be coated, in pellet form, is placed in an appropriate container such as a stainless steel mesh basket and dipped into the coating with agitation for a time sufficient to completely coat the propellant, generally about 10 seconds. The basket is then withdrawn from the mix and suspended over the solution to drip and slightly dry for about 10 to 20 seconds. The coated pellets are then baked in an oven at about 120° to 200° C., preferably 140° to 160° C. for 0.5 to 2 hours, preferably 0.75 to 1.25 hours.

The propellant is weighed before and after coating to determine the weight and thickness of the coating which of course can be easily calculated by one skilled in the art. To decrease the weight of the coating more solvent can be added and conversely to increase the weight of the coating some solvent is permitted to evaporate. Generally the coating will constitute about 1 to 5 wt. % preferably about 2.5 to 3.5 wt. % based on the total weight of the coated pellet.

In order to further describe the present invention, the following non-limiting examples are given.

EXAMPLE 1

A pyrotechnic composition consisting of 8.54 weight percent of an acetal copolymer having a melt index of 9 (sold under the designation "Celcon"), 2.83 weight percent carbon black, 45.5 weight percent sodium chlorate, 20.8 weight percent calcium sulfate sesquihydrate, and 22.3 weight percent aluminum hydroxide is intimately mixed by ball milling under methylene chloride, dried, and pressed into pellets. The aforementioned weight percents are based on the total weight of the pyrotechnic composition.

These pellets are coated with an ignition enchancer composition consisting of 10 weight percent polyvinyl acetate, 4 weight percent of finely ground (20 M) polyethylene, 80 weight percent potassium perchlorate, 1 weight percent carbon black, and 5 weight % ferric oxide, wherein these weight percents are based on the total weight of the coating composition. The coating on the pellets should constitute about 3 weight percent based on the total weight of the coated pellet.

The coated pellets are then placed into a cylindrical steel casing, to which a nozzle is attached. The pellets are ignited and the burn rate is found acceptable for automobile safety restraint devices.

EXAMPLE 2

In pyrotechnic composition consisting of 80 weight percent sodium azide and 20 weight percent ferric oxide is intimately mixed by ball milling under methylene chloride, dried, and pressed into pellets. The pellets are coated with the ignition enhancer composition of Example 1 wherein the weight percent of the coating with respect to the pellet plus the coating is the same as in Example 1.

The coated pellets are then placed into a cylindrical steel casing, to which a nozzle is attached. The pellets are ignited and the burn rate is found acceptable for automobile safety restraint devices.

It is to be understood that variations and modifications of the present invention may be made without departing from the scope thereof. It is also understood that the present invention is not to be limited by the specific embodiments disclosed herein but only in accordance with the appended claims when read in light of the foregoing specification.

What is claimed is:

1. An ignition enhancer composition for pyrotechnic propellants which comprises;

(a) about 60 to 95 weight percent of an inorganic oxidizer selected from the group consisting of sodium chlorate, potassium chlorate, sodium perchlorate and potassium chlorate;

(b) about 5 to 20 weight percent of a combustible oxygen-containing polymeric compound selected from the group consisting of polyacetal resins and polyvinyl acetate resins;

(c) about 3 to 7 weight percent of a transition metal oxide;

(d) about 1 to 5 weight percent of a polyethylene resin having a particle size equal to or less than 150 microns; and (e) from 0 to 5 weight percent of carbon black, wherein all weight percents are based on the total weight of the composition.

2. The composition of claim 1 wherein said inorganic oxidizer is present in an amount of about 75 to 85 weight percent and said oxygen-containing polymeric compound is present in an amount of about 9 to 11 weight percent.

3. The composition of claim 2 wherein said inorganic oxidizer is potassium perchlorate, said oxygen-containing compound is polyvinyl acetate and said transition metal oxide is ferric oxide.

4. The composition of claim 3 including carbon black present in the amount of about 0.5 to 2 weight percent.

5. The composition of claim 1 wherein the inorganic oxidizer is potassium perchlorate.

6. The composition of claim 2 wherein the oxygen-containing polymeric compound is polyvinyl acetate.

7. The composition of claim 1 wherein the transition-metal oxide is selected from the group consisting of iron oxide, copper oxide, manganese oxide, and titanium oxide.

8. The composition of claim 7 wherein the transition-metal oxide is ferric oxide.

9. A pyrotechnic propellant composition suitable for use in inflating an inflatable device, said composition normally possessing less than desirable ignition properties, said composition being coated with an ignition enhancer composition comprising:

(a) about 60 to 95 weight percent of an inorganic oxidizer selected from the group consisting of sodium chlorate, potassium chlorate, sodium perchlorate and potassium chlorate;

(b) about 5 to 20 weight percent of a combustible oxygen-containing polymeric compound selected from the group consisting of polyacetal resins and polyvinyl acetate resins;

(c) about 3 to 7 weight percent of a transition metal oxide;

(d) about 1 to 5 weight percent of a polyethylene resin having a particle size equal to or less than 150 microns; and (e) from 0 to 5 weight percent of carbon black, wherein all weight percents are based on the total weight of the composition.

10. The coated pyrotechnic composition of claim 9 wherein the pyrotechnic propellant is comprised of a acetal copolymer, carbon black, sodium chlorate, calcium sulfate sesquihydrate, and aluminum hydroxide.

* * * * *